US009109863B2

(12) United States Patent
York

(10) Patent No.: US 9,109,863 B2
(45) Date of Patent: Aug. 18, 2015

(54) VIBRATING PROJECTILE

(71) Applicant: Andrew W. York, Portland, OR (US)

(72) Inventor: Andrew W. York, Portland, OR (US)

( * ) Notice: Subject to any disclaimer, the term of this patent is extended or adjusted under 35 U.S.C. 154(b) by 0 days.

(21) Appl. No.: 13/844,223

(22) Filed: Mar. 15, 2013

(65) Prior Publication Data

US 2014/0274499 A1 Sep. 18, 2014

(51) Int. Cl.
*F42B 6/04* (2006.01)
*F42B 6/08* (2006.01)
*F42B 12/34* (2006.01)

(52) U.S. Cl.
CPC ... *F42B 6/04* (2013.01); *F42B 6/08* (2013.01); *F42B 12/34* (2013.01)

(58) Field of Classification Search
USPC ..... 473/570, 578, 583
See application file for complete search history.

(56) References Cited

U.S. PATENT DOCUMENTS

| | | | | |
|---|---|---|---|---|
| 5,094,463 | A * | 3/1992 | Dryden | 473/570 |
| 5,141,229 | A * | 8/1992 | Roundy | 473/570 |
| 5,251,907 | A * | 10/1993 | Ady | 473/571 |
| 5,294,131 | A * | 3/1994 | Manske | 473/571 |
| 5,468,000 | A * | 11/1995 | Bennett | 473/570 |
| 6,736,742 | B2 * | 5/2004 | Price et al. | 473/570 |

* cited by examiner

*Primary Examiner* — John Ricci
(74) *Attorney, Agent, or Firm* — Marger Johnson & McCollom, P.C.

(57) ABSTRACT

A projectile that includes a vibrating function is presented. The vibrating projectile, such as an arrow, is structured to penetrate flesh of an animal more easily than a standard projectile. After the arrow has reached its target, a switch turns on a vibrating mechanism that causes the arrowhead, such as a broadhead to vibrate as it is traveling into the animal. This deeper penetration causes more injury to the animal and reduces the time between arrow penetration and animal expiration.

19 Claims, 7 Drawing Sheets

Vibrator ON

Vibrator OFF

Broadhead in OFF position

Broadhead in ON position

Broadhead in OFF position

Broadhead in ON position

Broadhead in open position and Vibrator ON

Broadhead in closed position and Vibrator OFF

VIBRATING PROJECTILE

FIELD OF THE INVENTION

This disclosure is directed to projectiles, and, more particularly, to projectiles having a vibrating feature as they enter their target.

BACKGROUND

Hunting is an ancient tradition that is still practiced for both survival and sport. In both cases the hunter's goal is to harvest the animal as humanely and quickly as possible.

While hunting using firearms is the most common form of hunting, especially when hunting big game such as elk and deer, hunting using a bow and arrow remains a popular activity. Bow hunters enjoy the increased challenge of hunting an animal using primarily mechanical means. In other words, it can be more physically challenging to harvest animals using a mechanically launched projectile, such as an arrow, than it is when using a firearm that accelerates its projectile as a result of a controlled explosion, often with the aid of ancillary sighting devices which can provide increased long range accuracy. This difference, however, can pose a problem because it can be more difficult to bring down an animal as efficiently with an arrow as it is with a bullet.

The archery industry has strived to increase the killing force of the bow and arrow system with various improvements. For instance, bows were made with stronger pulling force, which resulted in the arrow being launched with higher velocity. The higher velocity translates to more damage done by the arrow, which results in quicker, more efficient harvesting of animals. When bows approached the limit of not being able to be effectively drawn and held by the archer, compound bows were developed that created additional mechanical force by using cams or lobed pulleys in conjunction with the bow and bowstring. Because of their let-off, these compound bows can have increased launching force and the ability to hold the bow at full draw for precision targeting with the use of a bow sight. Compound bows are now the most common bow used in hunting, especially big game hunting.

Arrows and especially arrowheads have also changed over time to increase the likelihood that the animal is quickly brought down. Broadheads have evolved from the stone heads of ancient times to the current broadheads made of metal. Generally broadheads have two to four fixed blades which may be finely sharpened to deeply penetrate the animal and cause massive internal bleeding. This minimizes the time between arrow penetration and animal expiration. Further, if the arrow does not kill quickly enough, the animal may travel significant distance after it is struck, increasing the likelihood that the animal may not be recovered, or that the animal unnecessarily suffers before dying.

Mechanical broadheads may also be used by hunters. Mechanical broadheads have two positions, a retracted position for flight and a second position that is deployed after the arrow strikes the animal. When the arrow strikes the animal, the broadhead switches from the flight position to the strike position, exposing its blades, which causes more damage to the animal than if the broadhead remained in the flight position. Mechanical broadheads generally penetrate the animal less deeply than fixed broadheads because some of the kinetic energy of the arrow is used to release the mechanical broadhead, although the increased damage to the animal that a mechanical broadhead causes may outweigh the kinetic energy loss, as they can have greater flight aerodynamics in the retracted position and a larger diameter cutting capability in the fully deployed open position upon impact with targeted animal.

Mechanical broadheads do not always work as intended, however. Depending on such variables as velocity, arrow weight, strike location, strike angle, etc., the mechanical broadheads may not fully deploy their mechanical blades or they may use too much of the arrow's kinetic energy to cause sufficient damage to the animal to bring it down quickly and humanely. In these cases it may have been better to use a fixed broadhead rather than the malfunctioning mechanical broadhead. The hunter does not know before the arrow strike, however, whether the mechanical or fixed broadhead would have been better for the particular shot. Lack of penetration has been cited as a significant factor in non-lethal shots which are, of course, to be avoided.

Embodiments of the invention address these and other limitations of the prior art.

SUMMARY OF THE INVENTION

Aspects of the invention include a projectile, such as an arrow, that includes an elongated shaft and a cutting head coupled to the shaft. Further included is a vibrator structured to vibrate the cutting head after the projectile strikes a target. The vibrator may be controlled by a switch, which may be a mechanical or acceleration switch. The switch may change states as the arrow strikes its target. The vibrator may be located anywhere within the arrow system, such as the nock, shaft, threaded insert, or the cutting head of the projectile. The switch may be co-located with the vibrator, or may be located between components of the arrow. The vibrator may be an electric motor, or may be powered by a mechanical spring, or by other means. Embodiments are also directed to a broadhead including a vibrator function, a threaded insert including a vibrator function, and an arrow shaft including a vibrator function.

DETAILED DESCRIPTION

Figure 1:
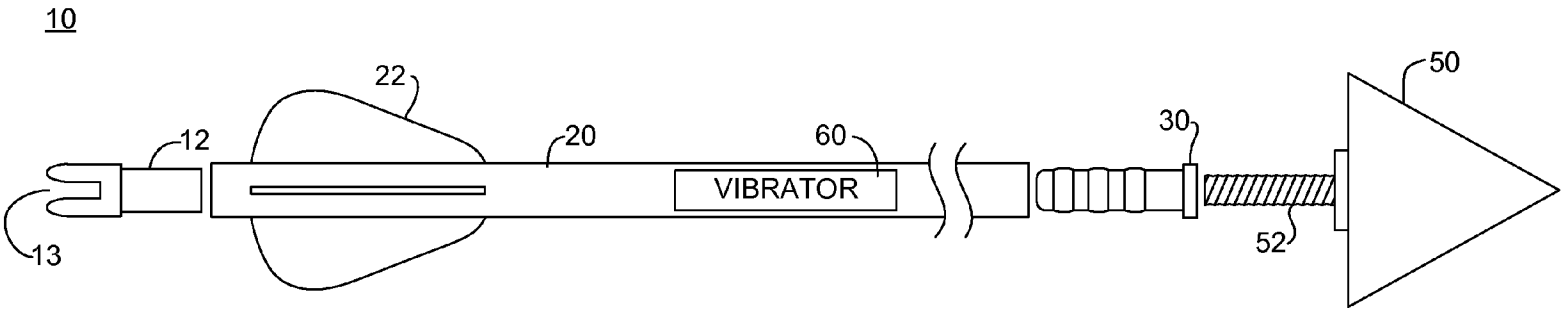
FIG. 1 is a side view of an arrow having a vibrator according to embodiments of the invention.

Penetration of a projectile such as an arrow into a game animal is dictated by factors such as the amount of kinetic energy retained by the arrow at impact, the time over which such energy is dissipated into the animal, the trajectory of the arrow, and the point of entry into the animal, as well as the sharpness, shape, and orientation of the broadhead blades, for example.

This disclosure generally describes a projectile having a vibrating function to increase penetration of the projectile into the desired animal thereby increasing the size of the wound channel. The larger wound channel causes more trauma and can bring down the animal quicker than the smaller wound channel that would have been created without vibration.

In this disclosure the projectile is described with specific references to an arrow, however the projectile may be embodied in other forms, such as a spear, blowdart, crossbow bolts, etc. Additionally, the movement described in the projectile is described as vibration, which also includes or may additionally include reciprocation, oscillation, pulsation, rotation, agitation or other motion.

When an arrow separates from the bow as it is being launched, it holds the maximum amount of kinetic energy for its flight to the target. In other words, as the arrow travels to its target, it is continuously losing kinetic energy. The lost energy is mostly transferred to the air in the form of drag, which is a function of arrow speed as well as the size and shape of the arrow, including its shaft and fletching. The density of the air through which the arrow is flying is also a factor, with denser air producing more drag. The amount of kinetic energy transferred into the target is roughly equal to the initial kinetic energy of the arrow less the kinetic energy lost during flight. Some of the energy of the arrow may be lost to other factors as well, such as heat lost to the atmosphere and the animal, and the sound generated by the impact of the arrow.

When striking the target animal, the kinetic energy is transferred to the animal in the form of momentum, which is a measure of the energy applied from the force of the arrow to the animal over time. More specifically, the arrow momentum is the integral of the force applied to the animal over the time the force is applied. In more detail, the arrow momentum is applied to the animal through the broadhead of the arrow, which penetrates the animal by cutting, ripping, and tearing strands of its flesh and, possibly, bone and cartilage. The amount of penetration is dependent on the momentum of the arrow, which, as described above, is related to its energy and time the energy is applied. The penetration depth is also dependent on the resistance force of the animal, which is, of course, determined by the physical makeup of the animal itself. Bones may provide more resistance to arrow travel than muscle, for instance, which in turn may provide more resistance than organs or other tissue. This resistance is related to the sectional density of the target.

FIG. 1 is a side breakaway view of an arrow 10 having a vibrator according to embodiments of the invention. The arrow 10 includes a main shaft 20 upon which feathers or fletching 22 are mounted. The fletching 22 stabilizes the arrow 10 during flight. A nock 12 is attached to the main shaft and includes a recess 13 into which the bowstring is received for launching the arrow 10. The nock 12 may also include an LED or other locating signal generating device, such as light or sound that may help the hunter trace the arrow during flight towards the target and also retrieve an arrow that either missed its target or has traveled completely through the target, or is still protruding from the targeted animal which has been struck and is being recovered.

A threaded insert 30 is inserted into the shaft 20 at the end opposite the nock 12. The threaded insert 30 is typically made of metal such as aluminum and is held fast within the shaft 20, by means such as glue (not shown) or held by merely a mechanical friction fit. Typically the threaded insert 30 includes an internally threaded receiver (not shown) into which threads 52 of a broadhead 50 may be received and tightened. The broadhead 50 may be metal and formed by metal injection molding, machining and/or multiple part assemblies.

A vibrator 60 is included within the arrow 10. Although the vibrator 60 is illustrated as being within the shaft 20, the vibrator may be disposed in any convenient location, such as the shaft 20, the threaded insert 30, the broadhead 50, or even in the nock 12. In some embodiments the vibrator 60 is completely contained within the arrow, but in other embodiments the vibrator may extend beyond an outer surface of the arrow 10. Description of the vibrator 60 mechanism is provided below. Many details of the vibrator 60 may be dictated by its particular implementation.

In the most common embodiment, when the arrow 10 is launched from a bow (not shown), the vibrator 60 is in an OFF state, i.e., it is not vibrating. Once the arrow 10, or any part of it, strikes a target, a switching mechanism turns the vibrator 60 to an ON state. The vibrator 60 causes the arrow 10, and especially its broadhead 50, to vibrate, reciprocate, oscillate, pulsate, rotate, agitate, or otherwise move. This movement amplifies the cutting ability of the broadhead 50 as it passes through the flesh/bone of the target animal, which allows for deeper penetration of the arrow 10. The vibration motion may also increase the size of the wound channel and the damage therein. The vibration may also help the shaft slide through the wound channel with reduced frictional drag due to the vibrating action. As mentioned above, deeper penetration and a larger wound channel is desirable in hunting because it minimizes the time between arrow penetration and death of the animal.

In some embodiments the vibrator 60 is set to vibrate at a particular frequency, such as between 10 and 500 Hz, and more particularly between 150 and 225 Hz. One embodiment causes the broadhead 50 to oscillate at 170 Hz, which may be the most efficient frequency at causing the broadhead 50 to cut muscle/organs.

In other embodiments the vibrator 60 may be a mid-frequency vibrator set to vibrate at between 5 kHz and 15 kHz. In yet other embodiments the vibrator 60 may be an ultrasonic or near ultrasonic vibrator set to vibrate at between 15 kHz and 20 kHz.

Vibrational energy may be conveniently provided by a motor, described below, or could be provided in other forms. For example vibrational energy may be stored in a wound spring and, upon striking the animal, a switch releases the spring to unwind, releasing its energy.

The vibration of the arrow 10 may also be implemented to amplify the vibration of the broadhead 50 so as to maximize the cutting efficiency of the broadhead.

Figure 2B:
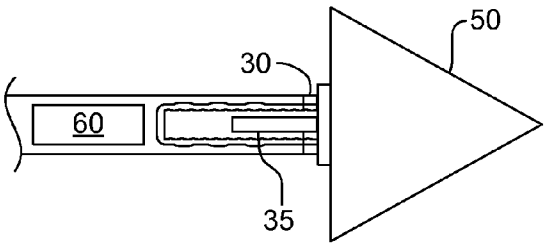
FIG. 2B is a partial side view of the arrow of FIG. 2A illustrating the arrow in a position that enables a vibrating function of the arrow according to embodiments of the invention.
Figure 2A:
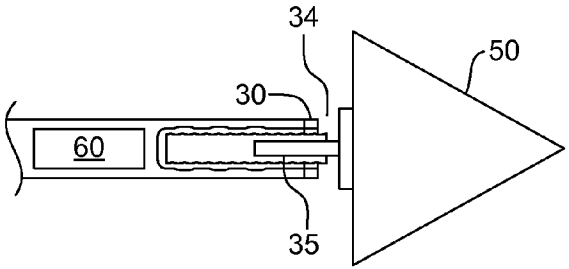
FIG. 2A is a partial side view of an arrow illustrating an arrow in a flight position according to embodiments of the invention.

FIGS. 2A and 2B are partial side views of a broadhead illustrating operation of a switching mechanism for controlling the operation of the vibrator 60 according to embodiments of the invention. In FIG. 2A, the broadhead 50 is separated from being fully seated in the threaded insert 30 by a gap 34. The gap 34 may be caused by a mechanically operated switch, a pin 35 of which is shown, that has physically separated ON and OFF states. Thus, when the gap 34 is present, the switch is in the OFF state, which controls the vibrator 60 to also be in the OFF state.

With reference to FIG. 2B, after the broadhead 50 of the arrow 10 has struck a target, the switch is mechanically driven to the ON state by the broadhead 50 suddenly striking the target while the remainder of the arrow continues on its path until the gap 30 is eliminated and the switch turned ON, such as by moving its pin 35. The switch then turns ON the vibrator 60 which, as described above, causes the broadhead 50 to be driven further into the animal than if no vibrator were present. The broadhead 50 may be held in place by small O-rings, snap-rings or other mechanical means.

The switch may also function to turn on the audible and/or visible locating signal in the nock 12 described above with reference to FIG. 1. In other embodiments the locating signal may be switched on by other means, such as an acceleration or physical switch located in the nock 12 itself.

Figure 3A:
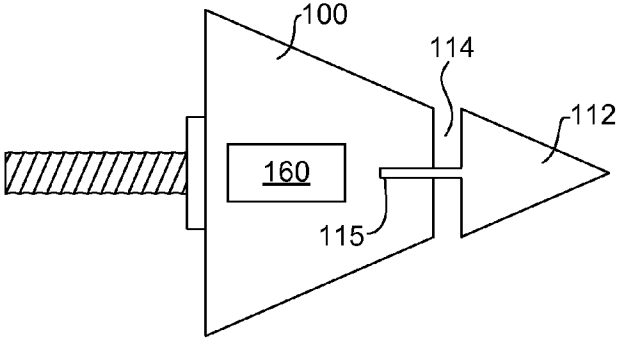
FIG. 3A is a partial side view of a broadhead illustrating the broadhead in a flight position according to embodiments of the invention.

FIG. 3A is a partial side view of a broadhead 100 illustrating the broadhead in an OFF or flight position according to embodiments of the invention. Differently than in the embodiment of FIG. 2A, the embodiment illustrated in FIG. 3A is a self-contained vibratory broadhead 100 that includes a vibrator 160 and a switching mechanism 115. The broadhead 100 includes a positionable tip 112 that has two positions. It is illustrated in an open position in FIG. 3A and illustrated in a closed position in FIG. 3B. When the tip 112 is in the open position of FIG. 3A, including a gap 114, the switching mechanism 115 is in an OFF state, and consequently the vibrator 160 is likewise off. When the tip 112 is in the closed position of FIG. 3B, and the gap 114 is not present, then the switching mechanism 115 turns to an ON state, and consequently the vibrator is turned ON. This increases the cutting ability of the broadhead 100 as described above. The positional tip 112 may be held in place by small O-rings, snap-rings or other mechanical means.

Figure 3B:
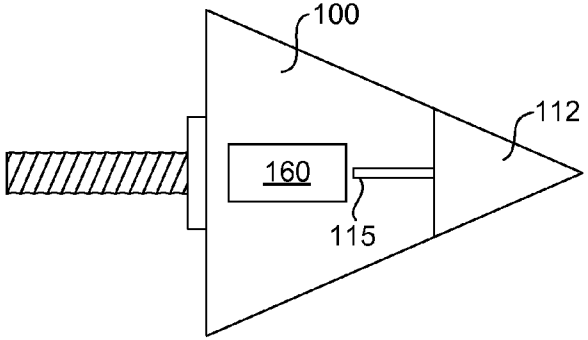
FIG. 3B is a partial side view of the broadhead of FIG. 3A illustrating the broadhead in a position that enables a vibrating function of the broadhead according to embodiments of the invention.
Figure 3C:
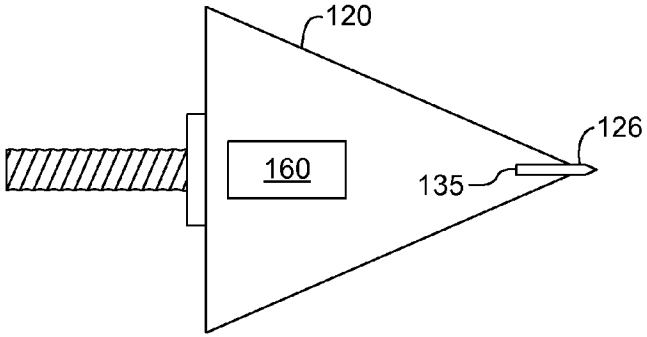
FIG. 3C is a partial side view of another broadhead illustrating the broadhead in a flight position according to embodiments of the invention.
Figure 3D:
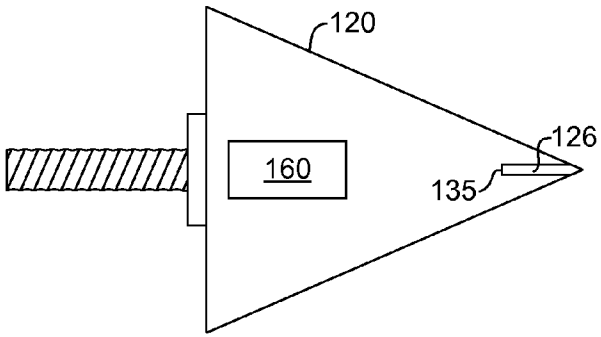
FIG. 3D is a partial side view of the broadhead of FIG. 3C illustrating the broadhead in a position that enables a vibrating function of the broadhead according to embodiments of the invention.

FIGS. 3C and 3D show an embodiment of a broadhead 120 that operates similarly to the broadhead 100 of FIGS. 3A and 3B, except that a switching mechanism 135 is controlled by a position of a relatively small sharp-tipped pin 126 located near the top of the broadhead 120. When the pin 126 is in the open state of FIG. 3C, the vibrator 160 is OFF, and when the pin 126 is in the closed state of FIG. 3D, the vibrator 160 turns ON. The pin 126 may be held in place by small O-rings, snap-rings or other mechanical means.

Figure 3F:
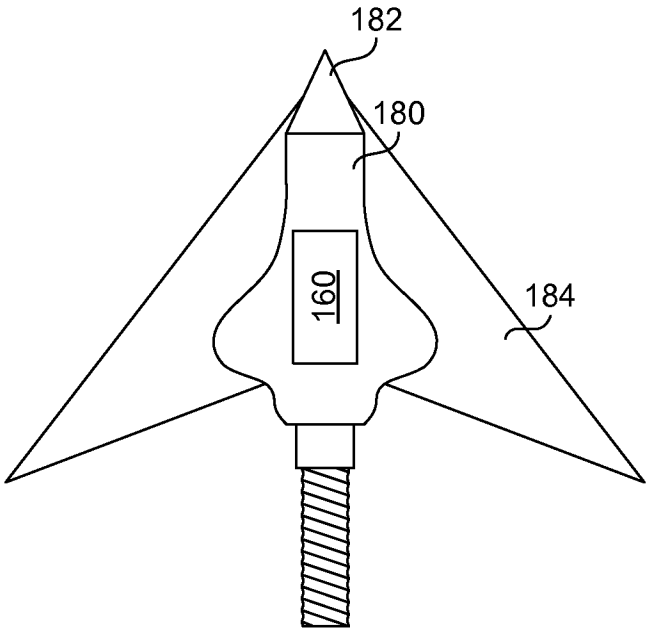
FIG. 3F is a partial side view of the broadhead of FIG. 3E illustrating the broadhead in an open position according to embodiments of the invention.
Figure 3E:
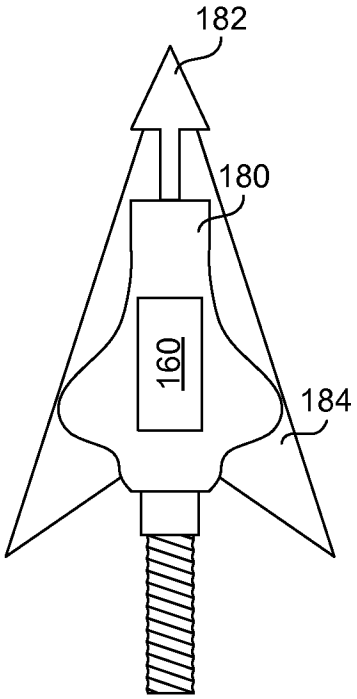
FIG. 3E is a partial side view of a mechanical broadhead illustrating the broadhead in a closed position according to embodiments of the invention.

FIGS. 3E and 3F show an embodiment of a broadhead 180 of the mechanical type that includes two physical positions, a closed position illustrated in FIG. 3E, and an open position illustrated in 3F. While in the closed position of FIG. 3E, blades 184 are held close to the longitudinal axis of the broadhead 180 and a tip 182 is in an extended position. Then, when the arrow strikes its target, the tip 182 of the broadhead 180 moves to the closed position as illustrated in FIG. 3F. Moving the tip 182 to the closed position activates the blades 184 to extend away from the longitudinal axis, and expanding the size of the wound channel created by the broadhead 180. In addition, the tip 182, or other switching mechanism as described herein, controls the operation of the vibrator 160 that vibrates the broadhead 180. In this way, the arrow to which the broadhead 180 is attached can travel to its target having its blades 184 in the closed position and the vibrator OFF, then, after striking the target, the blades move to the open position and the vibrator is turned ON. In some embodiments the tip 182 controls operation of both functions, while in other embodiments each function, i.e., extending the blades 184 and operating the vibrator 160 may be controlled by separate switches, and therefore operated independently from one another. As described above, the tip 182 need not be in the shape as illustrated, and may take nearly any form that allows its function.

Although the above embodiments describe a switching mechanism that controls operation of the vibrator 60, 160, it is possible that the vibrator 60 or 160 be manually controlled by the hunter before launching the arrow. In other words, in some embodiments the hunter may turn ON the vibrator 160 before launching the arrow or upon arrow launch with the use of a nock switch. The arrow may travel less efficiently through the air on its way to the target, but such performance may be acceptable to eliminate the operation of the switch that turns ON or OFF when the arrow strikes the target. Such an embodiment may be preferable when the cost of including the switch is prohibitive, or to eliminate the possibility of the switch not operating properly.

Figure 4:
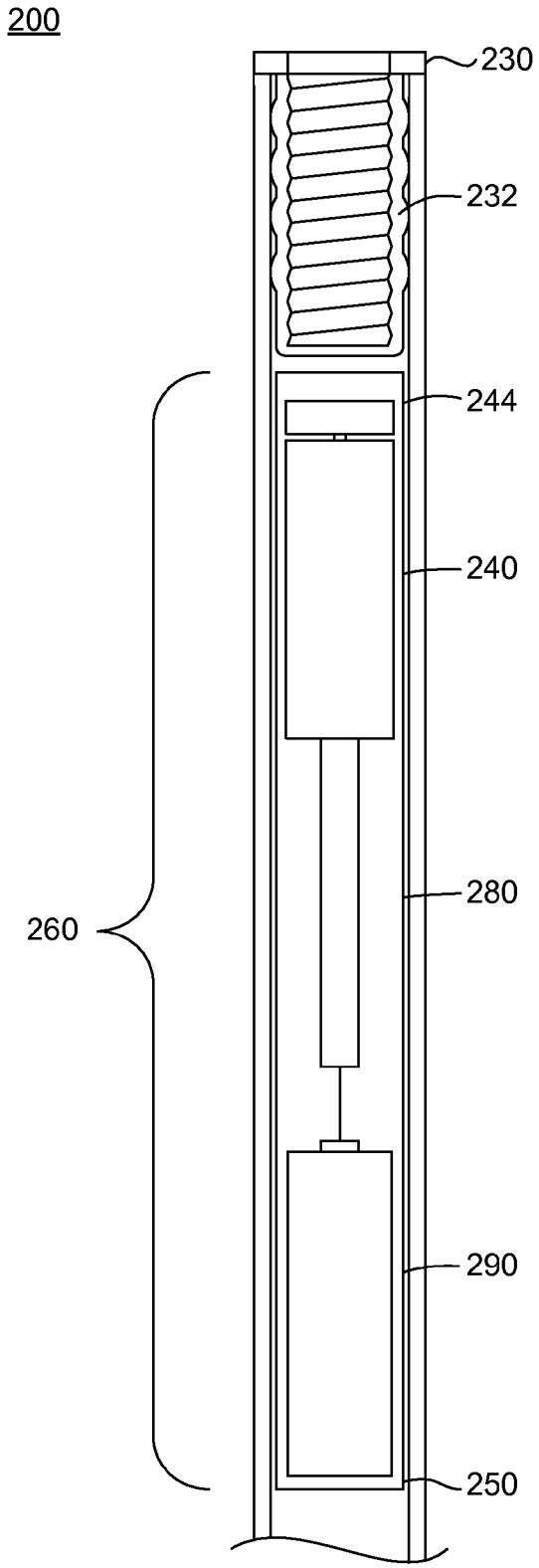
FIG. 4 is a side view of an arrow shaft having a threaded insert therein that includes a vibrating mechanism according to embodiments of the invention.

FIG. 4 is a side view of an arrow shaft 200 having a threaded insert 230 that includes a vibrating mechanism according to embodiments of the invention. The threaded insert 230 includes a threaded receiver 232 for receiving a standard broadhead (not shown) or even a field point for an arrow or other head. A vibrator 260 includes a vibratory motor 240 powered by a battery 290. A switch 280 may be mechanical or based on an accelerometer as described below. A housing 250, such as plastic, nylon, or aluminum, may be used to receive and hold all of the components of the vibrator 260.

The vibratory motor 240 is coupled to a spinning head 244 that is either eccentrically mounted or not completely circular. The spinning head 244 may be shaped as an approximate one-half cylinder as is known. In one embodiment the motor has a body diameter of approximately 6 mm and a length of approximately 10.3 mm. When spinning, the vibratory system generates approximately 2.4 G at 11,500 rpm, for example.

The switch 280 may be a mechanical switch as described above, or may instead be an electrical switch. Some embodiments could use an accelerometer-controlled G switch, which may be able to detect acceleration in one or more than one direction. For example, the switch may be able to detect when the projectile was launched, during acceleration, or may be able to detect when the projectile hits a target, during deceleration. Other switches may be able to detect both acceleration and deceleration. Embodiments could use specifically designed accelerometer switches mounted to a circuit board, for example, to control the switching function.

An advanced switch 280 may include a dual-direction g-sensor that is structured to turn on when the arrow strikes a target and structured to turn off when the arrow is struck on its nock. In such an embodiment the vibrator 260 may be initially in an OFF state, then turn ON when the arrow strikes the target and the switch detects a change in the g-force. After the arrow is retrieved, the hunter could turn off the vibrator 260 by tapping the arrow on its nock, in other words, in the reverse direction that caused the switch to turn on.

The switch 280 may also be embodied by other types of switches, such as an impact switch, crush switch, or electrical switches, such as an electrical resistance detector coupled to the broadhead or shaft. In the latter example the electrical resistance would change when the arrow strikes the animal, which, in turn could be used to signal the start of the vibrator. Similarly the switch 280 could be a capacitive detector triggered by sensing a change in capacitance.

The battery 290 may be a 1.5 volt or 3 volt lithium battery, or other battery, sized to fit within the shaft of the arrow, or other power supply appropriately shaped and sized for the implementation. The battery 290 may be of the rechargeable type and structured to recharge through a plug (not shown), or structured to be charged by connecting electrodes (not shown) near the edge of the threaded insert 230 to a power source.

The entirety of the vibrator 260, including the motor 240, switch 280, and battery 290 may be self-contained within the shaft 200, which may be made of aluminum or carbon, for example. The vibrator 260 may first be placed into the encapsulating housing 250, such as formed of plastic or aluminum, before being inserted into the shaft 200.

FIGS. 5A, 5B, 5C, and 5D are side views of example blades of a broadhead shaped to maximize vibrational energy according to embodiments of the invention. As described above, the broadhead typically includes two, three, or four blades, although embodiments of the invention work with any number of blades in the broadhead.

Figure 5A:
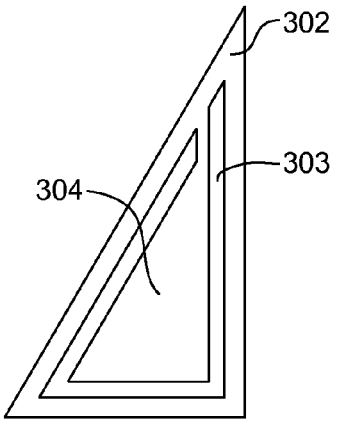
FIGS. 5A, 5B, 5C, and 5D are side views of example blades of a broadhead shaped to maximize vibrational energy transferred to the cutting blades according to embodiments of the invention.

A blade 302 in FIG. 5A includes solid portions 302, 304 as well as a void 303. As described above, blades, such as blade 302 may be made by any means, although it may be convenient to make blades by metal injection molding. After being removed from the mold, one or more edges of the blade are sharpened, in some cases as sharp as a razor. Solid portion 304 of blade 302 is designed to maximize vibrational oscillation as solid portion 304 is a suspended feature. In other words, the long vertical edge as illustrated in FIG. 5A is held fast in the broadhead to which it is attached to. Then, as the broadhead vibrates, the solid portion 304 vibrates even more than the main body of the broadhead, as the sold portion 304 is only connected to the blade 302 through a small sliver of material between the solid portion 304 and main blade portion 302.

Figure 5B:
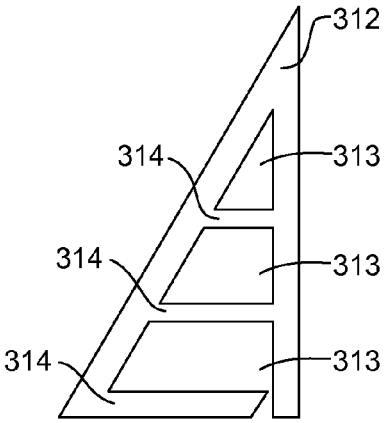
Figure 5C:
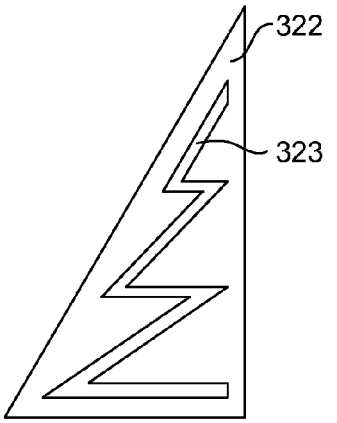
Figure 5D:
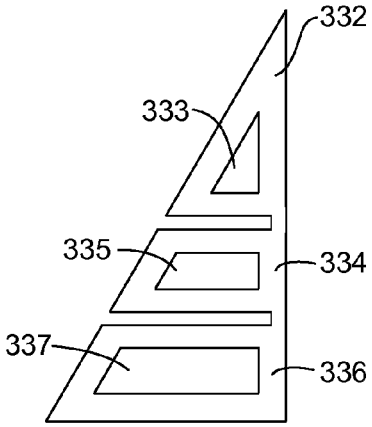

As illustrated in FIG. 5B, a blade 312 includes sold portions 314 as well as voids 313. Blade 322 of FIG. 5C includes a single void 323, and a blade illustrated in FIG. 5D includes three, or any number of, separate sections 332, 334, and 336, each having their own void 333, 335, 337, respectively.

Blades illustrated in FIGS. 5A-5D may be used in a broadhead to amplify the vibrations generated as described above. For instance, the blade 302 may vibrate, and thus translate more energy into the animal as the arrow to which it is attached pierces and travels through the animal. Different designs and shapes are possible in addition to those illustrated in FIGS. 5A-5D, which are merely examples to illustrate the concept. Particular blades may be matched to the size and speed of the vibration.

In some embodiments the entire arrow system such as described above may be tuned to using particularized parameters such as parameters of the blades, broadhead, shaft size, length, and weight, material, vibration displacement, vibration speed, vibration direction, etc—to maximize vibrational cutting efficiency.

Figure 6:
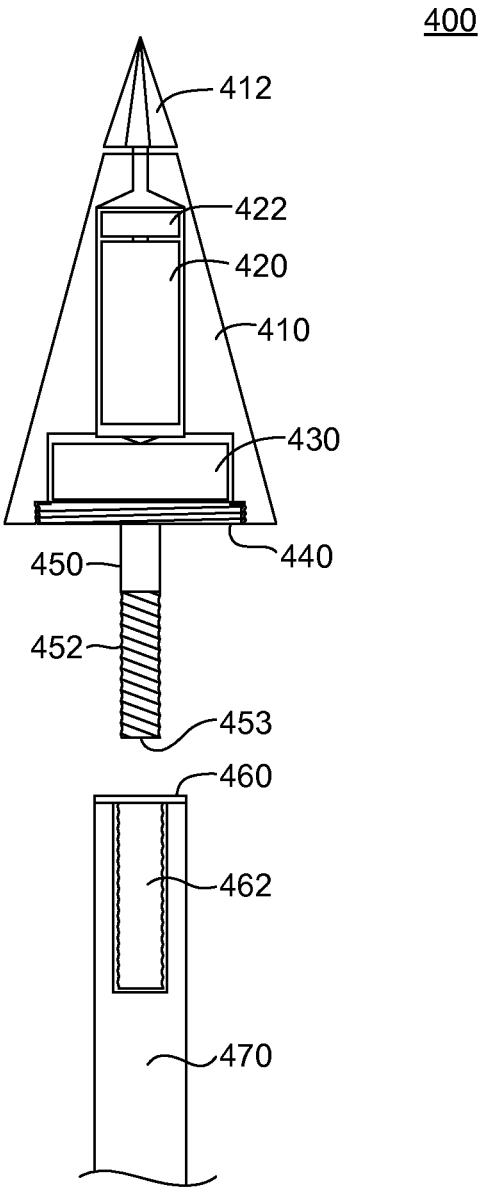
FIG. 6 is a side view of a vibrating mechanism for a projectile according to embodiments of the invention.

FIG. 6 is a side view of an example broadhead including a vibrating mechanism according to embodiments of the invention. A projectile 400 including a vibrator is illustrated. Differently than in the embodiment illustrated in FIG. 4, the entire vibrator is included in a broadhead 410, which is sized and shaped to be inserted into a standard threaded insert 460 for an arrow shaft 470. In this way hunters may add a vibrator to their existing arrows simply by inserting the broadhead 410.

In more detail, the broadhead 410 includes a vibrator motor 420 attached to a weight 422. As described above, the weight 422 is off-balance relative to a spinning shaft of the motor 420 and, when the motor 420 spins, the weight 422 imparts a vibrating motion to the broadhead 410 which radiates through the arrow shaft 470 and other parts of the arrow.

A coin cell battery 430 is also wholly contained within the broadhead 410 and provides power to operate the motor 420. Access to the battery 430 is provided by a removable cap 450 that also includes threads 452 to be received by corresponding threads 462 of the threaded insert 460. A receiver 453 in the cap 450 may be shaped to receive a hex/Allen wrench. Thus, to insert or change a battery, the user inserts a hex wrench in the receiver 453 and spins the cap 450 to separate it from the broadhead 410. Then the battery 430 may be inserted into the broadhead 410 and the cap replaced.

A mechanical switch is provided by a separated point 412 of the broadhead 410. As described above, the separated point 412 of the broadhead 410 has two positions, an extended position and a closed position. When the separated point 412 is in the extended position, no power is provided to the vibrator motor 420 and no vibration is imparted to the system. When the separated point 412 is in the closed position, such as after the broadhead 410 has struck the targeted animal, a mechanical switch is also closed which completes an electrical path between the battery 430 and the motor 420, causing the motor to spin and impart vibration to the system. Broadhead 410 may alternatively include a motion switch as described above. In such a case it is likely that the point 412 would be integrated into the broadhead 410.

Figure 7:
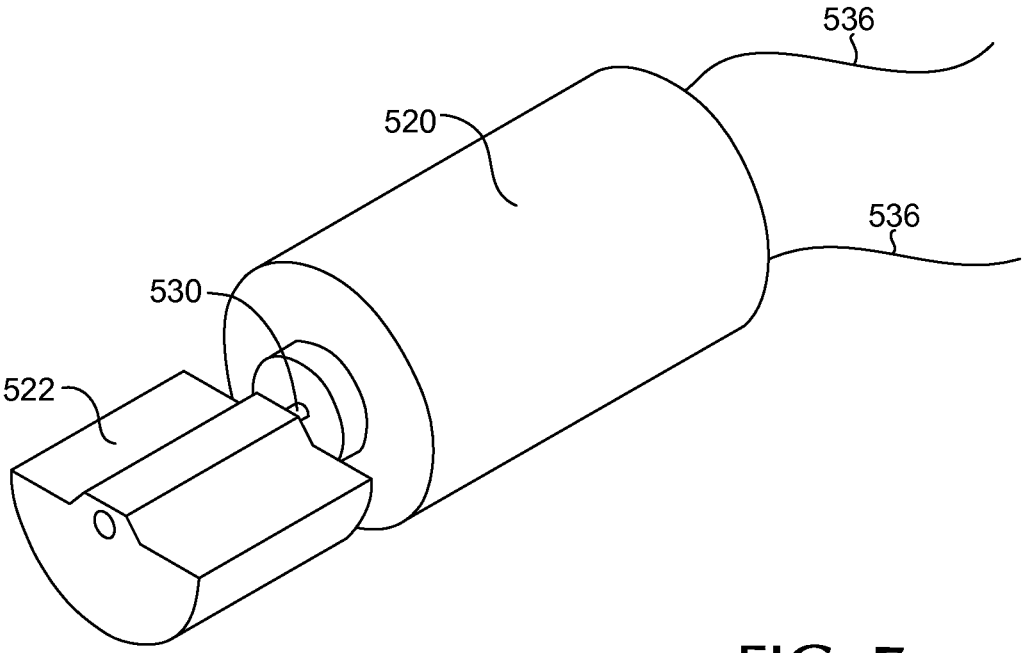
FIG. 7 is an isometric drawing of a vibrating motor used in embodiments of the invention.

FIG. 7 is a detailed isometric view of a vibrator motor 520 including a shaft 530 and weight 522. As illustrated, the weight 522 is offset or asymmetric about the shaft 530. When powered through a pair of leads 536, the motor spins the shaft 530, which in turn spins the offset weight 522.

Figure 8:
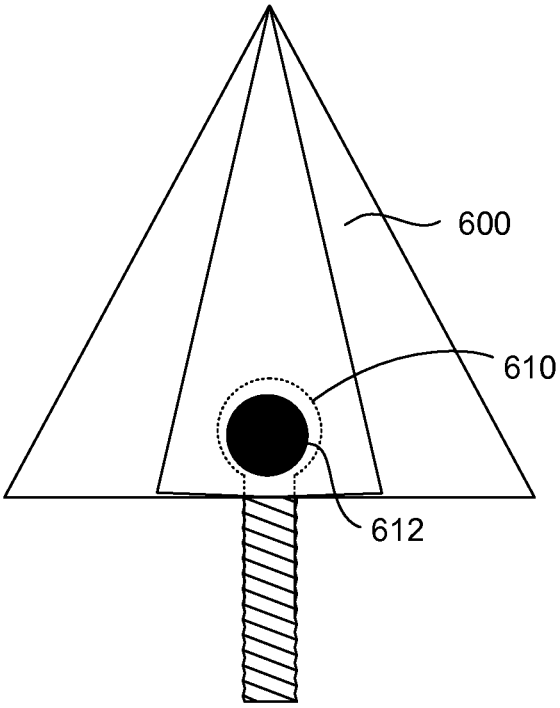
FIG. 8 is a side view of a broadhead including a vibrational resonance chamber according to embodiments of the invention.

FIG. 8 is a side view of a broadhead 600 including a vibrational resonance chamber 610 according to embodiments of the invention. The broadhead 600 is sized to fit within a standard threaded insert, and may be used with the vibrational threaded insert illustrated in FIG. 4 or any other embodiment. The broadhead 600 includes a resonance chamber 610 into which a vibrational weight 612 is formed, placed, or inserted. When the broadhead 600 vibrates, the vibrational weight 612 moves within the resonance chamber 610 until it strikes the side of the resonance chamber. The vibrational weight 612 is preferably metal, but other materials could be used. This interaction of the vibrating broadhead 600 and the weight 612 in the resonance chamber 610 amplifies the vibrating action of the vibrator. Different broadheads 600 may include resonance chambers 610 of various sizes. Similarly, the vibrational weight 612 may be larger or smaller depending on application and design. By including these variations different broadheads 600 may be selected depending on the particular mechanics of the vibrator system, and depending on how much vibration the hunter wishes to generate for the particular purpose.

Although described above as the vibrator being wholly contained in the arrow shaft, or wholly contained within the broadhead, a hybrid option is possible that includes various components in various locations. Thus, the energy source could be contained in the nock, shaft, threaded insert, broadhead, or separately attached to the arrow system. The energy source may be shared with other energy-consuming devices in the arrow system, such as lights or audio devices sometimes used to provide tracking of arrow flight path and a retrieving signal to the archer.

The vibration mechanism such as the vibrator motor and asymmetric weight could likewise be placed in the nock, shaft, threaded insert, broadhead, or separately attached to the arrow system. Finally, as described above, the switch to initiate the vibration could be located in the nock, shaft, threaded insert, broadhead, or separately attached to the arrow system. The switch may also be located between various components. For example a switch could be integrated into where the nock inserts into the shaft, into where the threaded insert inserts into the shaft, into where the broadhead inserts into the threaded insert, or at the base, midline, or tip of the broadhead. In such embodiments the switch may include a small or weak spring to keep the sections physically separated but that readily collapses when the arrow strikes a target. When the spring deforms, the switch turns on. A stay-on circuit, such as one including a silicon-controlled rectifier, or similar device could be used to keep the vibrator operating even after the spring had returned to its resting position after having struck the target.

In all of the embodiments an additional lighting circuit could be easily integrated into the vibrating circuitry to illuminate when the vibrator was vibrating. For example an LED could be mounted with the nock, arrow shaft, threaded insert, or broadhead to illuminate when the vibrator was vibrating. The LED could be powered by the same power source as the vibrator motor, and could be switched on using the same switch that controls the vibrator.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated.

In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

What is claimed is:

1. A projectile, comprising:
an elongated shaft;
a cutting head coupled to the shaft; and
a rotating vibrator structured to vibrate the cutting head of the projectile.

2. The projectile according to claim 1, further comprising:
a switch structured to control operation of the vibrator.

3. The projectile according to claim 2 in which the switch is structured to change from a first state to a second state when the projectile strikes the target.

4. The projectile according to claim 3 in which the switch is a mechanical or acceleration-sensing switch.

5. The projectile according to claim 2 in which the switch is disposed in one of the shaft, a threaded insert, the nock, or the cutting head of the projectile.

6. The projectile according to claim 2 in which the switch is disposed between a nock and the shaft, the shaft and a threaded insert, or between the threaded insert and the cutting head of the projectile.

7. The projectile according to claim 1 in which the projectile is an arrow and in which the cutting head is a broadhead.

8. The projectile according to claim 1 in which the rotating vibrator is an electric motor, the projectile further comprising an energy source for the electric motor.

9. The projectile according to claim 1 in which the shaft is also structured to vibrate when the cutting head vibrates.

10. A broadhead structured to be inserted into a shaft of an arrow, the broadhead comprising a vibrator structured to vibrate the broadhead after or before the broadhead strikes a target.

11. The broadhead according to claim 10 in which the vibrator comprises:
a motor having a shaft;
an asymmetric weight coupled to the shaft; and
a power source to power the motor.

12. The broadhead according to claim 11, further comprising a switch to engage the motor only after the broadhead strikes the target.

13. An insert for insertion into an arrow shaft of an arrow, the insert comprising a rotating vibrator structured to vibrate the arrow after the arrow strikes a target.

14. The insert according to claim 13 in which the rotating vibrator comprises:
a motor having a shaft;
an asymmetric weight coupled to the shaft; and
a power source to power the motor.

15. The insert according to claim 14, further comprising a switch to engage the motor only after the arrow strikes the target.

16. The insert according to claim 13 in which the insert is threaded.

17. An arrow shaft of an arrow, the arrow shaft comprising a rotating vibrator structured to vibrate the arrow after the arrow strikes a target.

18. The arrow shaft according to claim 17 in which the rotating vibrator comprises:
a motor having a shaft;
an asymmetric weight coupled to the shaft; and
a power source to power the motor.

19. The arrow shaft according to claim 17, further comprising a switch to engage the motor only after the arrow strikes the target.

* * * * *